US008779260B2

(12) United States Patent
Acosta

(10) Patent No.: US 8,779,260 B2
(45) Date of Patent: Jul. 15, 2014

(54) MOVABLE CAPO DEVICE

(76) Inventor: Antonio Acosta, New York, NY (US)

( * ) Notice: Subject to any disclaimer, the term of this patent is extended or adjusted under 35 U.S.C. 154(b) by 206 days.

(21) Appl. No.: 13/180,269

(22) Filed: Jul. 11, 2011

(65) Prior Publication Data

US 2012/0011986 A1 Jan. 19, 2012

Related U.S. Application Data

(60) Provisional application No. 61/363,911, filed on Jul. 13, 2010.

(51) Int. Cl.
*G10D 3/00* (2006.01)

(52) U.S. Cl.
USPC ..... 84/318

(58) Field of Classification Search
USPC ..... 84/312 R, 317, 318
See application file for complete search history.

(56) References Cited

U.S. PATENT DOCUMENTS

| | | | | |
|---|---|---|---|---|
| 4,324,165 A * | 4/1982 | Wilkerson | ..... | 84/318 |
| 5,792,969 A * | 8/1998 | Shubb et al. | ..... | 84/318 |
| 6,271,448 B1 * | 8/2001 | Steinberger | ..... | 84/318 |

* cited by examiner

*Primary Examiner* — Kimberly Lockett
(74) *Attorney, Agent, or Firm* — Michael Ries

(57) ABSTRACT

A guitar capo device utilized by a user on a guitar fret board that includes a casing that includes a generally rectangular portion and a side attachment portion that runs across the guitar fret board, a roller that is disposed underneath the generally rectangular portion of the casing and a clamp lever to secure the guitar capo device to the guitar fret board that is integral to a spring that is housed in the casing. The device includes a felt contact pad that is disposed on the clamp lever and has direct contact with the guitar fret board to secure the device to the guitar fret board and a relief lever that is depressed to release pressure against the spring to open and loosen the clamp lever against the back of the guitar fret board.

18 Claims, 2 Drawing Sheets

MOVABLE CAPO DEVICE

This application claims priority to U.S. Provisional Application 61/363,911 filed on Jul. 13, 2010, the entire disclosure of which is incorporated by reference.

TECHNICAL FIELD & BACKGROUND

Existing capos can be clamped in a stationary position to a guitar, but do not have the ability to be moved up and down the neck of the guitar being utilized with the capo.

It is an object of the present invention to provide a movable capo device to be utilized with a guitar.

It is an object of the present invention to provide a movable capo device that can be moved from one position to another along a guitar fret board without losing pressure on the strings of the guitar along the fret board.

It is an object of the present invention to provide a movable capo device that can be clamped onto the neck of a guitar with one hand and slid up and down the neck of the guitar with the same hand.

What is really needed is a movable capo device to be utilized with a guitar that can be moved from one position to another along a guitar fret board without losing pressure on the strings of the guitar along the fret board that can be clamped onto the neck of a guitar with one hand and slid up and down the neck of the guitar with the same hand.

BRIEF DESCRIPTION OF THE DRAWINGS

The present invention will be described by way of exemplary embodiments, but not limitations, illustrated in the accompanying drawing in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
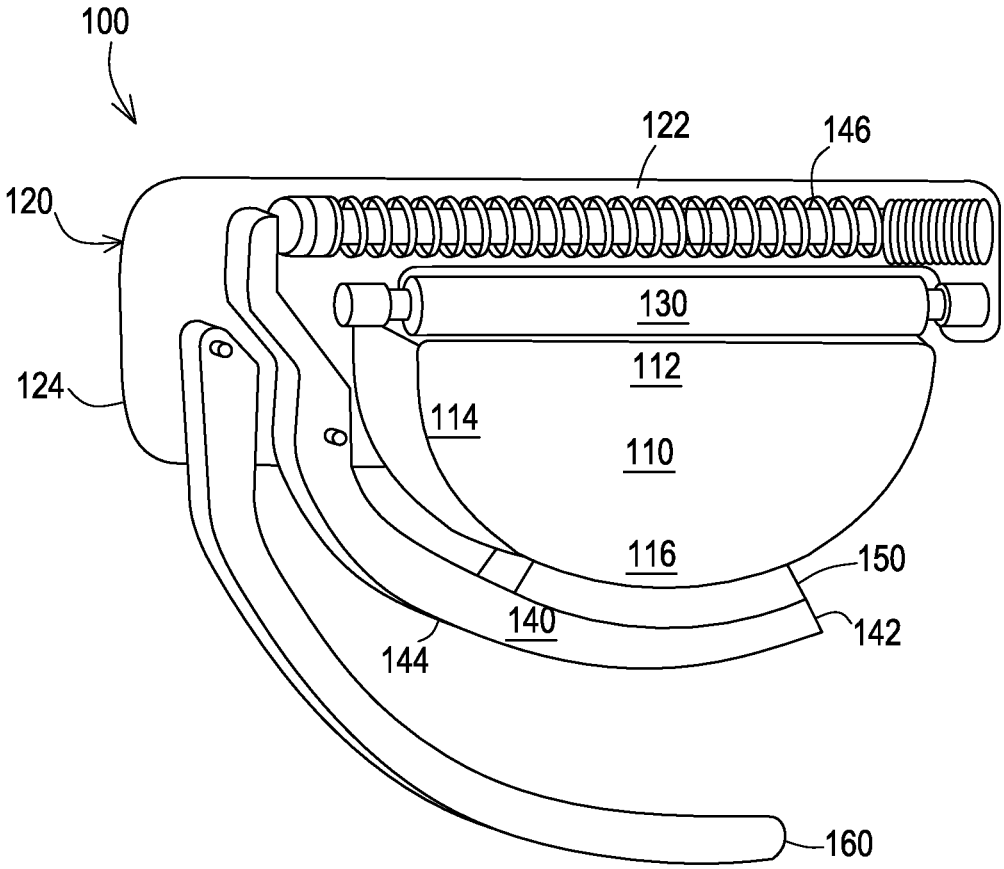
FIG. 1A illustrates a front environmental perspective view of a guitar capo device placed on a guitar fret board, in accordance with one embodiment of the present invention.

FIG. 1A illustrates a front environmental perspective view of a guitar capo device 100 placed on a guitar fret board 110, in accordance with one embodiment of the present invention.

The guitar capo device 100 includes a guitar fret board 110, a casing 120, a roller 130, a clamp lever 140, a contact pad 150 and a relief lever 160.

The guitar fret board 110 can be any suitable guitar fret board for any suitable guitar that can utilize the guitar capo device 100 which are typically a standard electrical and a non-electrical guitar. The casing 120 includes a generally rectangular portion 122 and a side attachment portion 124 and runs across the front 112 and to the side 114 of the guitar fret board 110 and enclose components or is a base for components that are attached to the casing 120. The roller 130 is disposed underneath the generally rectangular portion 122 of the casing 120 and allows the guitar capo device 100 to roll along the strings and the guitar fret board 110 of the guitar being attached to the guitar capo device 100. The clamp lever 140 includes a distal end 142 and an elongated curved arm 144 that extends around the back 116 of the guitar fret board 110 to secure the guitar capo device 100 to the guitar fret board 110. The clamp lever 140 is integral to a spring 146 that is housed in the generally rectangular portion 122 of the casing 120 that provides contact pressure to the back 116 of the guitar fret board 110. The spring 146 is typically a ¾$^{th}$" spring but can be any suitable sized spring. The contact pad 150 is disposed on the distal end 142 of the clamp lever 140 and has direct contact with the back 116 of the guitar fret board 110 to secure the guitar capo device 100 to the guitar fret board 110. The contact pad 150 is typically made of felt material but can be made of other suitable materials as well. The relief lever 160 can be depressed to release pressure against the spring 146 to open and loosen the clamp lever 140 against the back 112 of the guitar fret board 110.

The guitar capo device 100 can be placed and movably secured on the guitar fret board 110 and can be rolled from one position along the guitar fret board 110 to another desired position along the guitar fret board 110 without losing pressure on the guitar fret board 110. The roller 130 is disposed across the front 112 of the guitar fret board 110 and horizontally rotates along the front 112 of the guitar fret board 110 when moved along the front 112 of the guitar fret board 110. The guitar capo device 100 can be clamped and secured onto the guitar fret board 110 by the clamp lever 140 that is integral to the spring 146. The relief lever 160 can be depressed to release pressure against the spring 146 to open and loosen the clamp lever 140 against the back 112 of the guitar fret board 110.

Figure 1B:
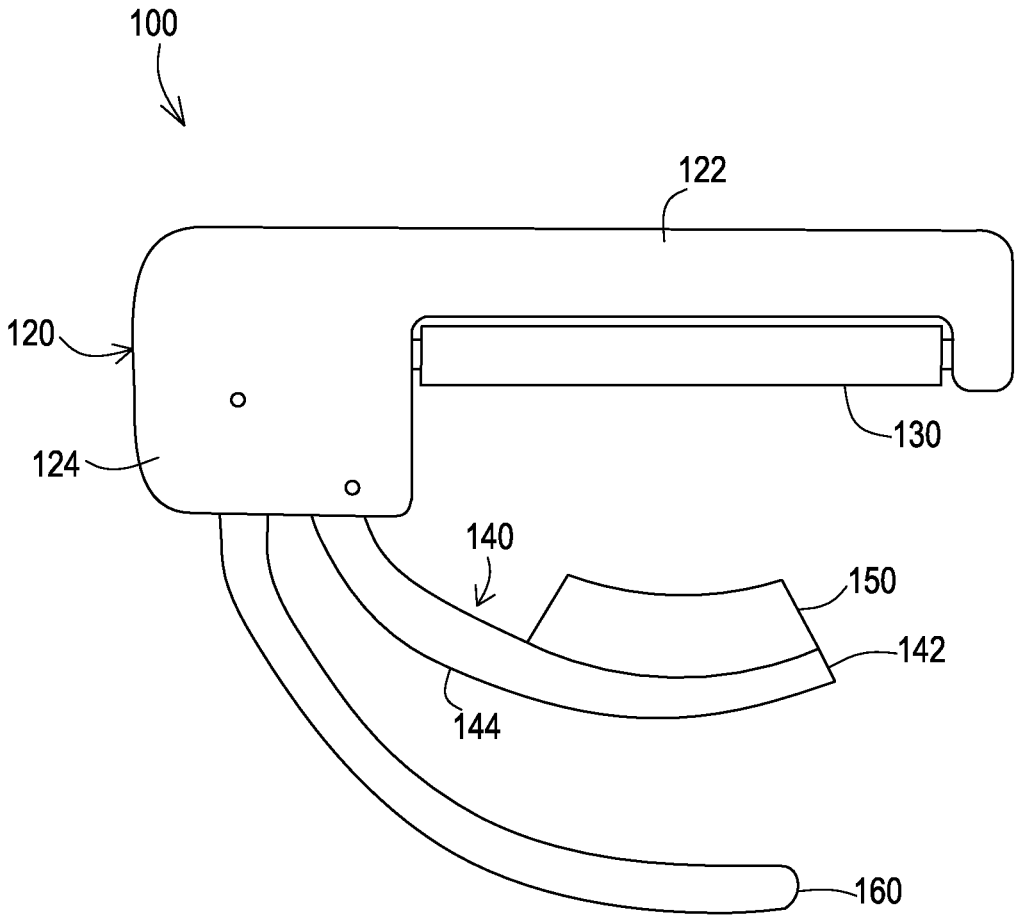
FIG. 1B illustrates a front perspective view of a guitar capo device, in accordance with one embodiment of the present invention.

FIG. 1B illustrates a front perspective view of a guitar capo device 100, in accordance with one embodiment of the present invention.

The guitar capo device 100 illustrated in FIG. 1A and described in the FIG. 1A description includes the same components as the guitar capo device 100 illustrated and described in FIG. 1B and its description. In contrast to the guitar capo device 100 illustrated and described in FIG. 1A, the guitar capo device 100 illustrated and described in FIG. 1B is covered and does not illustrate the exposed spring 146 and mechanical working relationship between the clamp lever 140 and the relief lever 160. The guitar fret board 110, the casing 120, the roller 130, the clamp lever 140, the contact pad 150 and the relief lever 160 of the guitar capo device 100 illustrated and described in FIG. 1A is identical to the guitar fret board 110, the casing 120, the roller 130, the clamp lever 140, the contact pad 150 and the relief lever 160 of the guitar capo device 100 illustrated and described in FIG. 1B.

A user can depress the relief level 160 to open the clamp lever 140 to place the guitar capo device 100 on the guitar fret board 110. The user can release the relief valve 160 to close the clamp lever 140 in a closed position and with the clamp lever 140 closed and locked on the guitar fret board 110, the user can roll the guitar capo device 100 up and down along the guitar fret board 110 as desired. The user can clamp the guitar capo device 100 with one hand and slid the guitar capo device 100 up and down the neck of the guitar fret board 110 with the same hand.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A guitar capo device utilized on a guitar fret board with a front, a side, a back and a plurality of strings, comprising:
- a casing that includes a generally rectangular portion and a side attachment portion that runs across said front and to said side of said guitar fret board;
- a roller disposed across said front of said guitar fret board, said roller horizontally rotates along the front of said guitar fret board when moved along said front of said guitar fret board and said roller allows said guitar capo device to roll along said strings and said guitar fret board being attached to said guitar capo device;
- a clamp lever that includes a distal end and an elongated curved arm that extends around said back of said guitar fret board to secure said guitar capo device to said guitar fret board;
- a contact pad that is disposed on said distal end of said clamp lever and has direct contact with said back of said guitar fret board to secure said guitar capo device to said guitar fret board; and
- a relief lever that is depressed to release pressure against a spring to said casing that includes a generally rectangular portion and a side attachment portion that runs across said front and to said side of said guitar fret board, said spring provides contact pressure to said back of said guitar fret board.

2. The device according to claim 1, wherein said clamp lever is integral to a spring that is housed in said generally rectangular portion of said casing.

3. The device according to claim 1, wherein said guitar fret board is a non-electric guitar fret board.

4. The device according to claim 1, wherein said guitar fret board is an electric guitar fret board.

5. A guitar capo device utilized by a user on a guitar fret board with a front, a side, a back and a plurality of strings, comprising:
- a clamp lever that includes a distal end and an elongated curved arm that extends around said back of said guitar fret board to secure said device to said guitar fret board that is integral to a spring that is housed in said generally rectangular portion of a casing;
- a felt contact pad that is disposed on said distal end of said clamp lever and has direct contact with said back of portion of said casing; and
- a relief lever that is depressed to release pressure against said spring to open and loosen said clamp lever against said back of said guitar fret board.

6. The device according to claim 5, further comprising a roller allows said guitar capo device to roll along said strings and said guitar fret board being attached to said guitar capo device.

7. The device according to claim 5, wherein said spring provides contact pressure to said back of said guitar fret board.

8. The device according to claim 5, wherein said guitar fret board is a non-electric guitar fret board.

9. The device according to claim 5, wherein said guitar fret board is an electric guitar fret board.

10. The device according to claim 5, wherein said user clamps said device with a first hand and slides said device up and down said guitar fret board with said first hand.

11. A guitar capo device utilized by a user on a guitar fret board with a front, a side, a back and a plurality of strings, comprising:
- a casing that includes a generally rectangular portion and a side attachment portion that runs across said front and to said side of said guitar fret board;
- a roller that is disposed underneath said generally rectangular portion of said casing;
- a clamp lever that includes a distal end and an elongated curved arm that extends around said back of said guitar fret board to secure said device to said guitar fret board that is integral to a spring that is housed in said generally rectangular portion of said casing;
- a felt contact pad that is disposed on said distal end of said clamp lever and has direct contact with said back of said guitar fret board to secure said guitar capo device to said guitar fret board; and
- a relief lever that is depressed to release pressure against said spring to open and loosen said clamp lever against said back of said guitar fret board.

12. The device according to claim 11, wherein said roller allows said guitar capo device to roll along said strings and said guitar fret board being attached to said guitar capo device.

13. The device according to claim 11, wherein said spring provides contact pressure to said back of said guitar fret board.

14. The device according to claim 11, wherein said spring is approximately ¾th of an inch in thickness.

15. The device according to claim 11, wherein said guitar fret board is a non-electric guitar fret board.

16. The device according to claim 11, wherein said guitar fret board is an electric guitar fret board.

17. The device according to claim 11, wherein said user releases said relief valve to close said clamp lever in a closed position and with said clamp lever closed and locked on said guitar fret board, said user rolls said device up and down along said guitar fret board.

18. The device according to claim 11, wherein said user clamps said device with a first hand and slides said device up and down said guitar fret board with said first hand.

* * * * *